US005636667A

United States Patent [19]

Young et al.

[11] Patent Number: 5,636,667

[45] Date of Patent: Jun. 10, 1997

[54] CONVERSION OF FUEL DISPENSERS TO PROVIDE FOR VACUUM ASSISTED VAPOR RECOVERY

[75] Inventors: Jonathan P. Young; Victor A. Schrand, both of West Chester, Ohio; Raymond C. Pilch, Grand Rapids, Mich.

[73] Assignee: Dover Corporation, New York, N.Y.

[21] Appl. No.: 399,156

[22] Filed: Mar. 2, 1995

[51] Int. Cl.[6] ..... B65B 31/00

[52] U.S. Cl. ..... 141/59; 141/7

[58] Field of Search ..... 141/7, 44, 45, 141/59, 290

[56] References Cited

U.S. PATENT DOCUMENTS

| | | | |
|---|---|---|---|
| 3,016,928 | 1/1962 | Brandt | 141/45 |
| 3,710,830 | 1/1973 | Gilson | 141/93 |
| 4,057,086 | 11/1977 | Healy | 141/44 X |
| 4,068,687 | 1/1978 | Long | 141/59 |
| 4,082,122 | 4/1978 | McGahey | 141/59 X |
| 4,202,385 | 5/1980 | Voelz et al. | 141/59 |
| 4,273,164 | 6/1981 | Gunn | 141/7 |
| 4,306,594 | 12/1981 | Planck | 141/59 |
| 5,150,742 | 9/1992 | Motohashi et al. | 141/59 |

*Primary Examiner*—J. Casimer Jacyna
*Attorney, Agent, or Firm*—Kinney & Schenk

[57] ABSTRACT

Fuel dispensers are converted to provide vaccum assisted recovery of vapors. Where previously provided with, or "plumbed" for, a pressure balance type of recovery system, the prior hose means is disconnected to permit mounting of a fuel driven, vacuum pump in communication with preexisting fuel and vapor conduit means. Where there has been no prior provision for vapor recovery, conduit means are installed to provide communication between the dispenser pedestal and a remote receiver for fuel vapors. One end of a coaxial hose, preferably of the inverted type, is mounted on the pump and the opposite end of the coaxial hose is connected to a vacuum assist nozzle.

10 Claims, 4 Drawing Sheets

CONVERSION OF FUEL DISPENSERS TO PROVIDE FOR VACUUM ASSISTED VAPOR RECOVERY

The present invention relates to improvements in fuel dispensers and more particularly to the conversion of existing dispensers to provide for vacuum assisted recovery of fuel vapors during the dispensing of fuel, thereby to minimize pollution of the atmosphere.

In response to ever increasing governmental pressures and regulations the petroleum industry, has increasingly made provision for recovering fuel vapors that are displaced from a fuel tank as fuel is discharged therein. Initial installations of vapor recovery systems, for retail filling stations, were made in areas of high atmospheric pollution and, almost exclusively, were of a type referenced as a pressure balance recovery system.

Basically, a pressure balance system involves the addition of a vapor return conduit system that extends from a dispenser nozzle, through a hose, to the dispenser pedestal and then through a conduit system (usually installed underground) to a point of disposal. Most frequently the means of disposal was simply to return the vapors to the storage tank from which fuel was being drawn to fill the fuel tank of a vehicle. As fuel is withdrawn in fueling a vehicle, the vapor space in the storage tank is increased. Conversely, as fuel is introduced into the fuel tank of a vehicle, vapor space is decreased to essentially an identical extent. The pressure differentials thus created cause the vapors to flow through the vapor conduit system from the nozzle back into the storage tank, thereby creating a pressure balance.

Most nozzles for pressure balance, vapor recovery systems comprise a bellows (also referenced as a boot) that surrounds the nozzle's spout. In delivering fuel, the spout is inserted into the inlet pipe of a vehicle fuel tank and the bellows is compressed to form a vapor seal with the inlet pipe. The bellows forms, in combination with the spout, an annular passage, which is the initial portion of the vapor return, conduit system. Vapors then flow through internal passages in the nozzle body to the hose end thereof. In most instances, the hose is of the coaxial type, with a central fuel passage and a surrounding, coaxial vapor return passage, being formed by flexible tubes. The coaxial hose is connected by a fitting to the side of the dispenser pedestal. Conduit means, within the pedestal connect with further conduit means, usually extending underground, that return the vapors to the storage tank. Fuel conduit means from that storage tank are connected to the pedestal fitting to which the coaxial hose is attached.

There is an alternate vapor recovery system in which a vacuum assist is provided for returning displaced vapors through the vapor return, conduit system. The vacuum assist eliminates the need to rely upon a compression seal between a bellows and fuel tank, inlet pipe, in order to prevent escape of vapors into the atmosphere. In most cases, the bellows is eliminated, since the vacuum of the vapor system is sufficient to draw substantially all of the displaced fuel vapors into inlet openings in the distal end of an essentially rigid spout, or in the spout end of the nozzle body. Vacuum assist nozzles also include a vapor return passage, usually formed interiorly of the nozzle body, for connection with a coaxial hose, at the opposite end of the nozzle. The vacuum assisted vapor system is greatly preferred from a standpoint of ease, resulting from a lighter nozzle construction and elimination of the need to compress a bellows.

At this point it would be noted that there are two different types of fuel dispensers of present interest. One type, known as "high hose" dispenser, usually has separate nozzles for each of three grades of fuel, on each side of the dispenser. The hoses for the nozzles are connected to and hang down from an elevated canopy. "High hose" dispensers are relatively expensive and their use is generally limited to high volume filling stations. It is also to be appreciated that, in most instances, more than one grade of fuel is available from a conventional "high hose" dispenser, thus contributing to its relatively high cost.

The second type of dispenser is known as a "low hose" dispenser and comprises a pedestal to which the hose connection is at a relatively low level, generally a foot or two from ground level, or the level of an island on which the "low hose" dispenser pedestal is mounted. "Low hose" dispensers generally comprise means for delivering a single grade of fuel, and usually include two nozzles so that that grade of fuel can be dispensed into vehicles on opposite sides of the dispenser.

"Low hose" dispensers are relatively inexpensive and, generally, are found in low volume filling stations. While the terms "high dispenser" and "low dispenser" are employed, the significant distinction between the two types of dispensers is primarily in the fact that one provides for the delivery of multiple grades of fuel and the other provides for the delivery of a single grade of fuel.

A broad and general object of the present invention is to maintain the competitiveness of low volume filling stations where vapor recovery is required by governmental regulation and it is also desired to provide the convenience of a vacuum assisted vapor recovery system.

A more specific object of the present invention is to provide for the conversion of "low hose" dispensers from a pressure balance, vapor recovery system to a vacuum assisted, vapor recovery system, in a simple and inexpensive manner.

Another and related object of the present invention is facilitate the provision of vacuum assisted vapor recovery systems in existing fuel dispensers and to achieve such end in a low cost fashion.

A further object of the invention is to achieve the foregoing ends in a manner that promotes safety in the event of fuel leakage.

In accordance with one aspect of the invention the foregoing ends may be attained by a method of converting a fuel dispenser from pressure balance, vapor recovery operation to vacuum assisted vapor recovery operation. The method is applicable where the dispenser comprises a pedestal, a pressure balance, fuel dispensing nozzle and a coaxial hose. The coaxial hose has fuel and vapor passages and is connected at one end to the nozzle. The preexisting structure also includes an adapter, on the pedestal, that has separate connections to a source of pressurized fuel and to a remote receiver for fuel vapors. The coaxial hose, at its other end, is connected to the adapter to place the hose, fuel passage in communication with the pressurized fuel source and place, the hose, vapor passage in communication with the remote receiver.

The conversion method comprises the steps of disconnecting the coaxial hose fitting from the adapter. A fuel driven, vacuum pump is then mounted on the adapter to place the source of pressurized fuel in communication with a pump, fuel passage and place the vapor receiver in communication with a pump, vapor passage. The pump has an impeller disposed in the pump vapor passage that is driven by flow of fuel through the pump fuel passage.

The method further includes mounting one end of a coaxial hose on the vacuum pump, to place a hose, fuel passage in communication with an outlet from the pump, fuel passage and to place a hose, vapor passage in communication with an inlet to the pump, vapor passage. A vacuum assist nozzle is mounted on the opposite end of the coaxial hose that is mounted on the vacuum pump. A vacuum assist is thus provided in drawing vapors into vapor passage means of the vacuum assist nozzle connected to the opposite end of the coaxial hose.

Where a dispenser has been previously plumbed for vapor recovery operation, but not used in a vapor recovery mode, there will be vapor conduit means and fuel conduit means internally of the pedestal. The vapor recovery means will be sealed by appropriate means, as a single passage hose connects a nozzle to the fuel conduit means.

In converting the last described form of preexisting dispenser, the sealing means are first removed so that a fuel driven pump, coaxial hose and vacuum assist nozzle can be mounted in the fashion above described.

Where there has been no prior provision for vapor recovery in the preexisting dispenser, it is necessary to first install conduit means that extend from a point adjacent the pedestal to a vapor receiver at a remote location. A fuel driven vacuum pump is then mounted, as referenced above, to the fuel and conduit means at the pedestal. Again, the conversion is completed mounting a coaxial hose on the vacuum pump and mounting a vacuum assist nozzle on the coaxial hose.

In all variations of the invention, advantages are found in, and it is preferred to employ an inverted coaxial hose, having an inner fuel passage and an annular vapor passage. By so doing the need for a condensate evacuator in the vapor passage in obviated.

Other features of the invention are found in mounting the fuel driven, vacuum pump on the structure of the pedestal and adjacent ground level. A related feature is found in mounting a guard on the vacuum pump.

The above and other related objects and features of the present invention will be apparent from a reading of the following description of preferred embodiments of the invention, with reference to the accompanying drawings and the novelty thereof pointed out in the appended claims.

Figure 1:
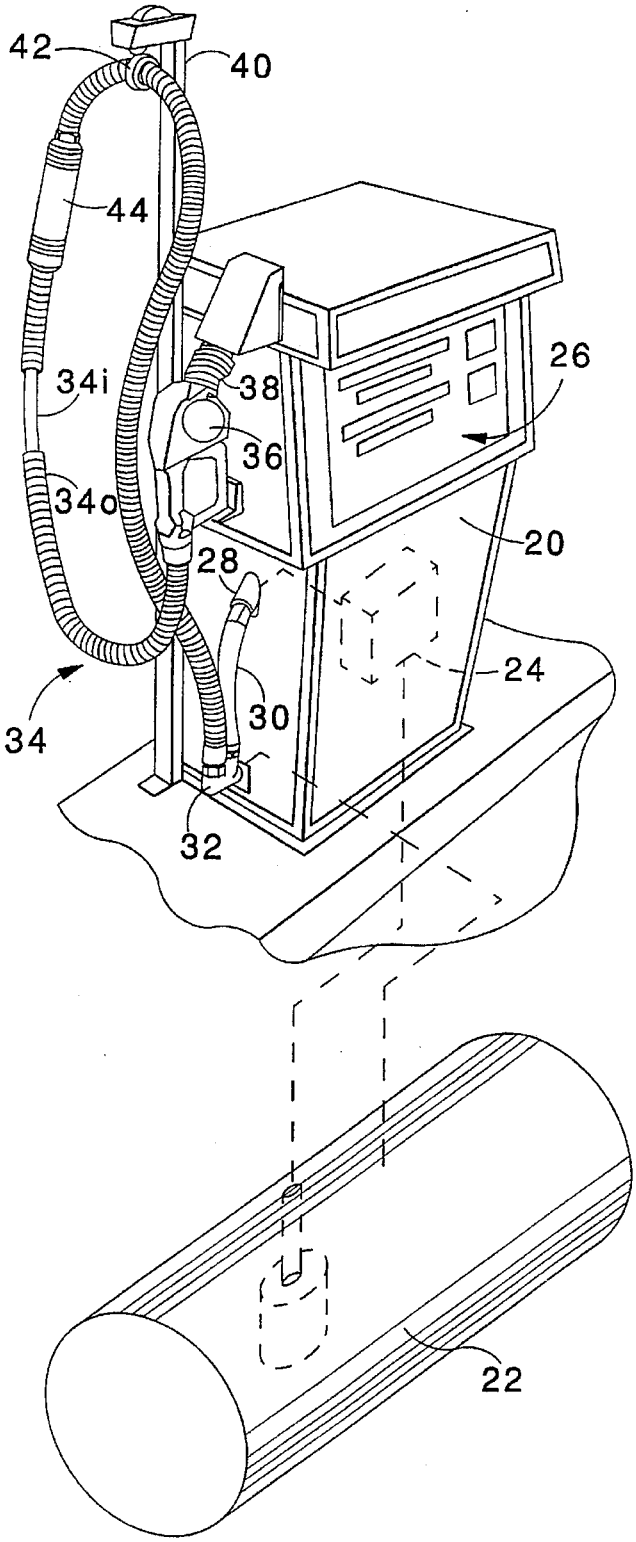
FIG. 1 (Prior Art)
FIG. 1 is a perspective view of a conventional, prior art, "low hose" fuel dispenser that is provided with balance type vapor recovery means.

FIG. 1 illustrates a prior art, conventional fuel dispensing system incorporating vapor recovery means of the pressure balance type. The system comprises a pedestal 20, also referenced as a dispenser, that may be mounted on an elevated island at a filling station. Fuel to be dispensed from the dispenser 20 is derived from an underground storage tank 22, being conveyed thereto by an underground conduit and conduits internally of the pedestal 20. The fuel drives a meter 24, mounted internally of the pedestal 20, and its output is shown on a register 26 that indicates the amount and cost of fuel delivered. Fuel next flows from the meter 24 to a fitting 28 and then through a jumper hose 30 to an adapter 32.

The adapter 32 has provision for connection of a coaxial hose 34 that has both fuel and vapor passages. The coaxial hose 34 comprises an inner tube **34*i* which defines the fuel flow passage and an outer, corrugated tube 34*o*, which, in combination with the inner tube 34*i*, defines the vapor return passage. The opposite end of the coaxial hose 34 is connected to a nozzle 36. The nozzle is provided with a bellows 38 which is utilized in providing a sealed connection with the inlet pipe of a vehicle fuel tank during the delivery of fuel from the nozzle. The sealed connection provides a vapor connection between the fuel tank and a vapor return flow path. The vapor return flow path extends through the nozzle, through the coaxial hose 34, to the adapter 32, and then through conduit means that extend internally of the dispenser 20 and then to the storage tank 22**.

An intermediate portion of the hose 34 is yieldably supported in an elevated position on a post 40 by a retractor 42. The hose is thus kept from engaging the ground to minimize wear. A breakaway device 44 is provided intermediate the length of the hose 34 to minimize damage in the event a vehicle is driven away with the nozzle lodged into its fuel tank. The provision of the retractor/post support and the breakaway device are both known expedients.

Again, the various components of the described fuel dispensing system, incorporating pressure balance, vapor recovery means is well known and the various components require no further description for those skilled in the art.

Figure 1A:
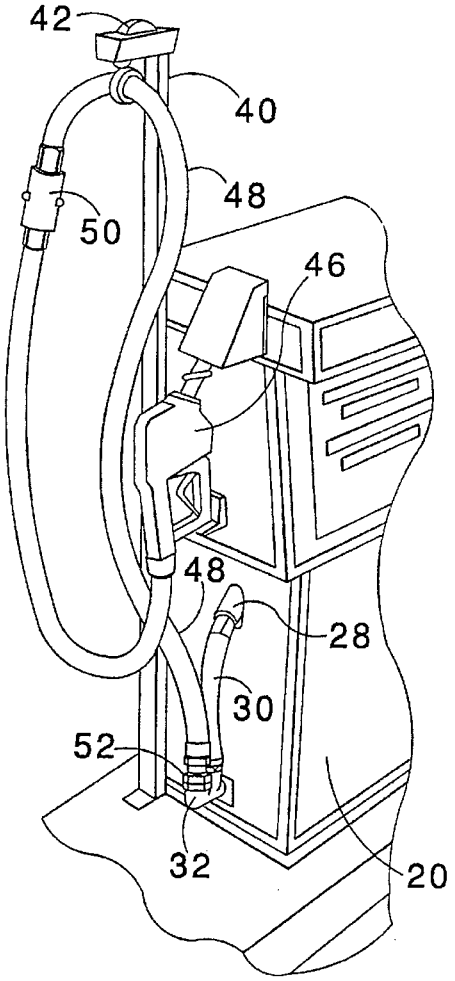
FIG. 1A (Prior Art)
FIG. 1A is a perspective view of the "low hose" fuel dispense of FIG. 1 fitted to dispenser fuel, without provision for vapor recovery.

FIG. 1A illustrates that the requirement for vapor recovery provisions in the dispensing of fuel has, for some while, been anticipated by manufacturers of fuel dispensers. This is to point out that there is now a substantial number of installed fuel dispensers that are internally "plumbed" to provide the necessary conduits and other connections required to provide a vapor recovery capability, but which are presently employed for the dispensing of fuel without utilizing that capability. Thus, a standard nozzle 46, hose 48 and breakaway 50 are substituted for the corresponding vapor recovery components of FIG. 1. The single passage fuel hose 50 is then connected to the adapter 32 and a suitable plug 52 employed to block the vapor inlet for the adapter.

FIGS. 1 and 1A illustrate two existing fuel dispenser installations that can be converted to a vacuum assisted vapor recovery system through the teachings of the present invention. In either case, the hose 34 or 48 is removed from the adapter 32 and, where the dispenser has been employed without using the vapor recovery capability, the plug 52 is also removed. The vacuum assist vapor recovery components can then be mounted on the preexisting adapter 32 which was provided for a pressure balance vapor recovery system.

The conversion components employed in the present invention comprise a vacuum assist nozzle 54, a coaxial hose 56 and a fuel driven vacuum pump unit 58.

Pressure balance and vacuum assist nozzles have in common both a fuel flow passage and a vapor return passage extending between a hose end and a spout. While, a pressure balance nozzle could be employed in a vacuum assist system, a vacuum assist nozzle is simpler in that means associated with establishing a sealed, vapor connection between the nozzle and the inlet pipe of the fuel tank are eliminated. The weight of a vacuum assist nozzle is thus significantly less than that of a pressure balance nozzle. Additionally it is not necessary to employ a high force to compress a bellows in maintaining a sealed connection with the fuel tank inlet pipe.

The details of an illustrative vacuum assist nozzle are found in U.S. patent application Ser. No. 986,521, filed Dec. 7, 1992, which is of common assignment with the present application. In that nozzle the major portion of the distal end of the spout is formed by two, concentric tubes, forming a central, fuel passageway and an annular vapor return passage. Openings in the outer tube provide inlets to an annular vapor return passage at the distal end of the outer spout tube. The annular spout passage communicates with a vapor return passage in the nozzle body and then to a vapor return passage in the coaxial hose that attaches it to the dispenser. Other forms of vacuum assist nozzles employ a single tube spout. In this form of vacuum assist nozzle, the vapor return passage, in the nozzle body, has an inlet at the base of the spout. A cone shaped baffle then guides vapors into this vapor inlet, without requiring a sealed connection of the type that makes pressure balance nozzles difficult to use.

The specific form of vacuum assist nozzle is not a feature of the present invention.

At this point it will be further noted that, in many localities, atmospheric conditions can cause fuel vapors to condense in the conduit system by which it is being returned from the nozzle to the underground storage tank (or other location). Accumulation of vapor condensate in the vapor return passage of the connecting coaxial hose has become a recognized cause of failure in the vapor recovery system, in that the condensate accumulates at the low point of a coaxial hose and blocks the return flow of vapors.

It has further been found that the problem of condensate blocking the vapor return passage of a coaxial hose is more acute in vacuum assist vapor recovery systems. This has led to the adoption of evacuators (known as slurpees) that aspirate condensate from the vapor return passage of the coaxial hose and returns the condensate to the fuel that is being discharged from the nozzle. Aspirators for the slurpee function may be mounted in the coaxial hose as taught in U.S. Pat. No. 4,687,033, or in the nozzle body as taught in U.S. Pat. No. 5,035,271.

At this point, reference is made to the above discussion between "standard" and "inverted" coaxial hoses, for a more detailed explanation of the significance of the difference between a standard, coaxial hose (having an inner, fuel passage and an annular vapor passage) and an inverted, coaxial hose (having an inner vapor passage and an annular, fuel passage). Suffice it to again point out that the problem of vapor condensate is greatly minimized, if not totally eliminated, where "inverted coaxial hoses" are employed in connecting a vapor recovery nozzle to a fuel dispenser.

Accordingly, one of the preferred features of the present invention is found in the use of connecting hoses 56 that are "inverted coaxial hoses".

It is to be appreciated that the broader aspects of the invention permit the use of either a "standard" coaxial hose or an "inverted" coaxial hose.

Figure 3A:
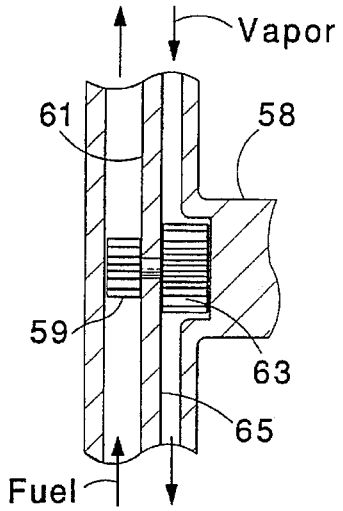
FIG. 3A is a schematic illustration of a fuel driven, vacuum pump employed herein.

The fuel driven, vacuum pump 58 comprises separate fuel and vapor passages. The pump 58 is schematically illustrated in FIG. 3A and comprises a turbine motor element 59 disposed in a fuel passage 61 formed in a body portion of the pump. A pump element 63 is disposed in a vapor passage 65 of the body portion of the pump 58 and is driven by the interconnected motor element 59. Flow of fuel through the fuel passage 61 drives the motor element 59 and thus creates a vacuum/suction that is proportional to the rate of fuel being discharged from the nozzle. The suction created is also proportionate to the amount of vapor being displaced from the fuel tank being filled and returned through the vapor return passages of the nozzle 54 and hose 56.

The use of a fuel driven, vacuum pump to create a suction force in a vacuum assist, vapor recovery system is well known. Exemplary teachings of such a fuel driven, vacuum pumps are found in U.S. Pat. No. 4,068,687. Thus, it is not necessary to disclose and describe in detail the fuel driven motor elements of the vacuum pump elements for creating a suction in the vapor return passage of the fuel driven, vacuum pump 58.

The fuel driven, vacuum pump 58 is provided with a fitting 60 that is adapted to be received by the adapter 32. The fitting 60 correspond to the fitting on the lower end of the coaxial hose that has been removed in renovating a dispenser of the type illustrated in FIG. 1. In such case, the adapter will most likely be configured for an adapter wherein fuel flow is through an inner tube and vapor flow is through an outer passageway. Similarly, due to the relatively recent initiation of the use of "inverted" coaxial hoses, the adapter 32 of the FIG. 1A installation will also, most likely, be configured for "standard" coaxial hose fitting wherein the fuel flows through an inner passage and vapor through an outer passage.

In any event, the fitting 60 is adapted to connect the vapor passage (65) of the pump 58 with the vapor passage of the adapter, that connects with the conduit means for returning vapors to the storage tank. Likewise, the fitting 60 is adapted to connect the fuel passage (61) of the pump 58 with the fuel passage of the adapter that connects with the fuel conduit means that extend to the underground storage tank.

If the adapter 60 should be designed for an "inverted" coaxial hose fitting, with vapor flow through an in inner passage and fuel flow through an outer passage, the fitting 60 can be modified accordingly. Alternatively, a pump with a "standard" coaxial fitting could be employed and then a flow reversing coupling inserted between the fitting 60 and the adapter 32.

In any event, when the fuel driven, vacuum pump 58 is mounted on the adapter 32, the fuel passage (61) of the fuel driven, vacuum pump 58 is placed in fluid communication with the pressurized fuel conduit means of the dispenser 20, by way of the jumper hose 30. Similarly, when so mounted on the adapter 32, the vapor passage (65) of the fuel driven, vacuum pump 58 is placed in fluid communication with the internally plumbed, vapor return conduit means of the dispenser 20 and then to the connecting conduit means extending to the storage tank 22.

The opposite, or upper end of the fuel driven, vacuum pump 58 is provided with adapter means 62 for receiving a fitting 64 that is attached to the "inverted" coaxial hose 56. When the hose fitting 64 is mounted in the fuel driven, vacuum pump adapter 62, the fuel passage of the fuel driven, vacuum pump is placed in fluid communication with the fuel passage of the hose 56 and the vapor passage of the fuel driven, vacuum pump is placed in fluid communication with the vapor passage of the hose 56. It is also to be noted that the vapor passage of the coaxial hose 56 is placed in fluid communication with the suction side of the vacuum pump of the fuel driven, vacuum pump 58.

Various and sundry fitting/adapter configurations are known to those skilled in the art for placing plural passages in communication by a single connection and, therefore, it is not deemed necessary to describe in detail the interacting passageway forming means of the fitting/adapter connections for the fuel driven, vacuum pump 58.

After connection of the hose 56 to the fuel driven, vacuum pump 58, the hose 56 can be attached to the retractor 42, as the vacuum assist, vapor recovery components replace the pressure balance components of FIG. 1 or the non-vapor recovery components if FIG. 1A. As before, a breakaway device 66 may be included in the hose 56.

It is to be recognized that the vacuum assist components of the present invention may be connected to the dispenser 20 in any convenient order and further, that those components may be separately removed for repair or replacement. It is also to be appreciated that the coaxial hose need not necessarily be replaced. It is possible to employ a "standard" coaxial hose in a vacuum assist vapor recovery system. The hose fitting/adapter connection with the fuel driven, vacuum pump 58 can be fashioned to accommodate either "standard" or an "inverted" coaxial hose. Similarly, the hose fitting/adapter connection between the nozzle and the coaxial hose can be for either a "standard" or an "inverted" coaxial hose. Thus, in accordance with the broader aspects of the invention, replacement of the coaxial hose is an optional step, in that the original hose may be connected to the fuel driven, vapor pump and the vacuum assist nozzle 54.

The conversion components are thus readily and rigidly mounted on the dispenser 20 in the simplest of fashions without the need of modifying the internal components of the dispenser 20 (assuming in the case of FIG. 1A that the internal vapor conduit means, were connected to further conduit means extending to the storage tank 22).

As a final step of the conversion process, a protective housing 68 may be mounted on the fuel driven, vacuum pump 58 to provide protection against a user being injured by any sharp projection on the pump unit, as well as to provide a measure of protection for the pump unit itself. Advantageously, the protective housing 68 may be in the form of a lightweight, plastic shell which is open on its side facing the dispenser 20 as well as being open on its bottom. Convenience may be served through the use of spring clips 70 to releasably grip the housing 68 on the fuel driven, vacuum pump 58.

Figure 5:
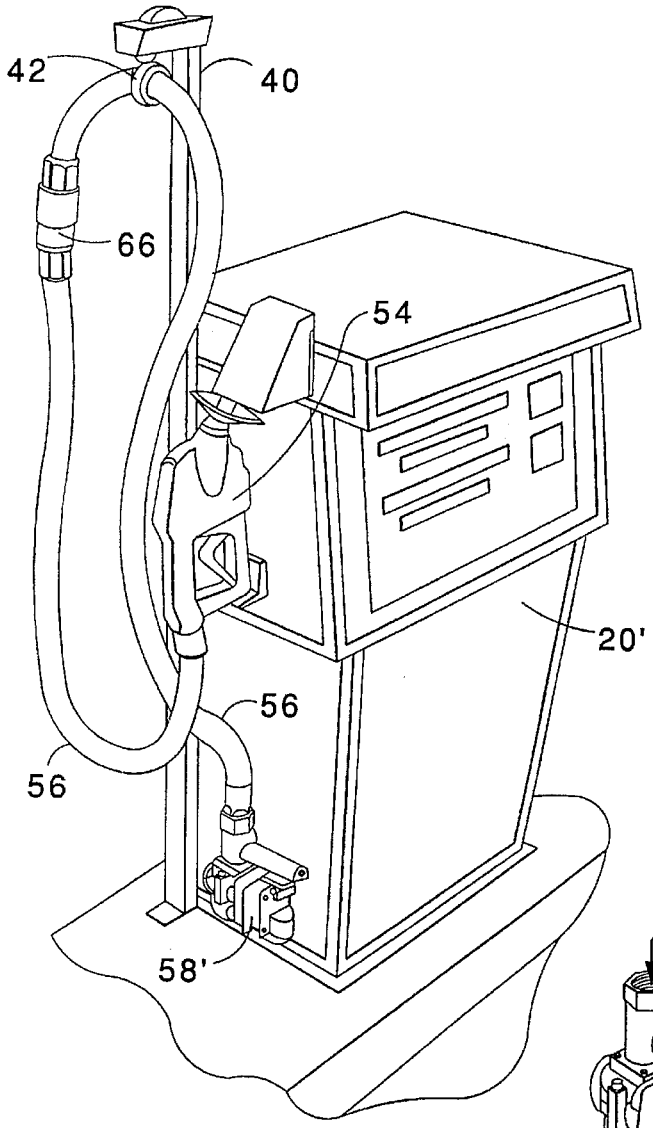
FIG. 5 is a perspective view of another "low hose" dispenser that is provided with alternate internal connections for providing both a fuel and a vapor return connection to a coaxial hose that is, in turn, connected to a fuel dispensing nozzle.

FIG. 5 illustrates the conversion of another type of dispenser that has been previously "plumbed" for the provision of a pressure balance, vapor recovery system. In this case, the dispenser, identified by reference character 20' is provided with internal conduits for both the fuel and vapor. These conduits are connected to a single fitting 32' and, respectively, to further conduits that connect the dispenser fuel conduit to the pressurized pump in a storage tank and the dispenser vapor conduit to the upper portion of the storage tank.

Figure 2:
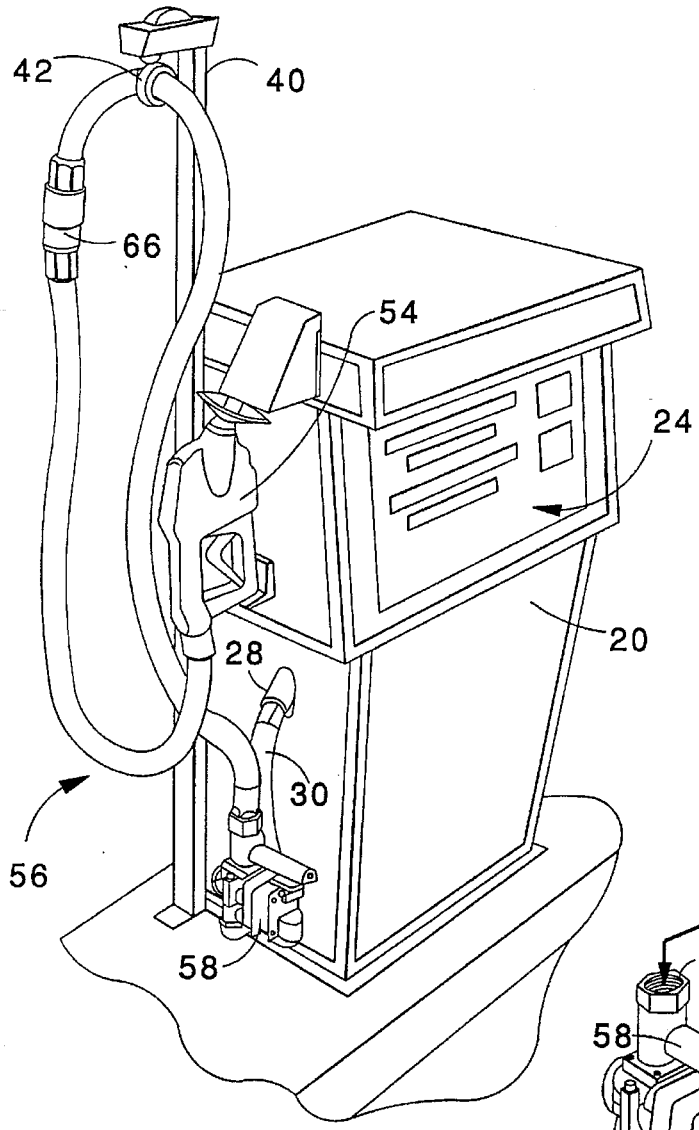
FIG. 2 is a perspective view of a "low hose" dispenser, as seen in FIGS. 1 and 1A, with the vacuum assist, vapor recovery means of the present invention mounted thereon.
Figure 3:
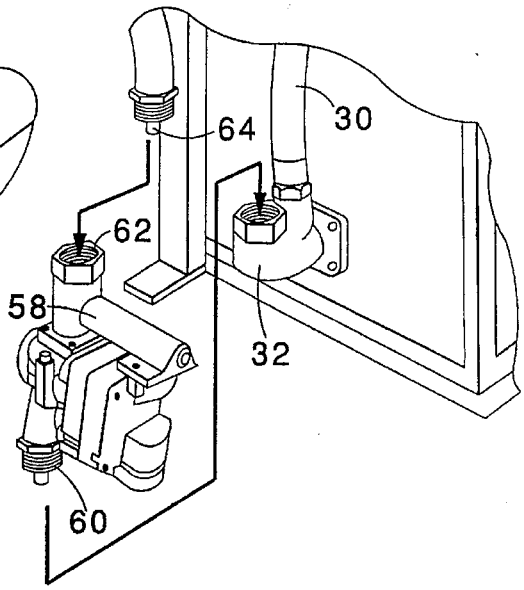
FIG. 3 is an exploded, perspective view illustrating operative relations for components of the present invention.
Figure 4:
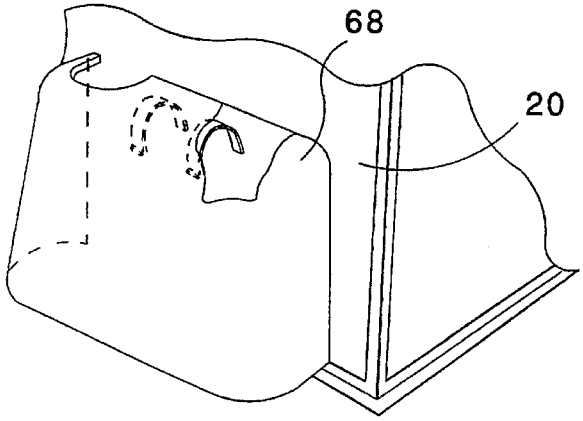
FIG. 4 is a perspective view illustrating the provision of a shield for pump components of the present invention.

The pressure balance components (nozzle 36 and hose 34) connected to the fitting 32' would be removed to convert the dispenser to vacuum assist operation. These elements would then be replaced by essentially the same elements as described in connection with FIGS. 2–4. Thus, a fuel driven, vacuum pump 58' is mounted on the adapter 32'. The fuel driven, vacuum pump 58' need differ from the previously described fuel driven, vacuum pump 58 only to the extent necessary to accommodate differences between the adapters 32 and 32' The coaxial hose 56 ("standard" or "inverted") and vacuum assist nozzle 54 of the previous embodiment may be employed in the same fashion as previously described in order to provide for vacuum assisted vapor recovery of vapors in the operation of the dispenser 20'.

Figure 6:
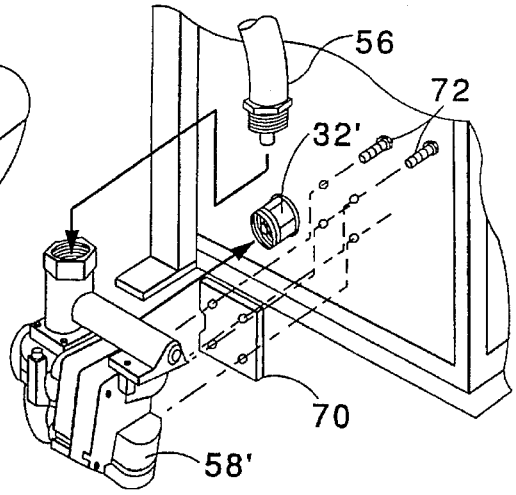
FIG. 6 is an exploded, perspective view illustrating the mounting of components of the present vacuum assist system on the dispenser of FIG. 5.
Figure 7:
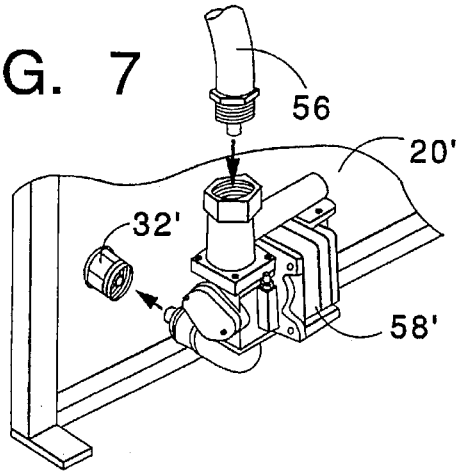
FIG. 7 is a perspective view, from a different angle, of the components of FIG. 6.

FIG. 6 further illustrates the provision of a reenforcing bracket 70 for the fuel driven, vacuum pump 58'. In providing the reenforcing bracket 70 it is convenient to gain access to the interior of the dispenser pedestal 20' in order to mount screws 72 that mount the plate on a side panel of the dispenser and are threaded into the fuel driven, vacuum pump 58.

Figure 8:
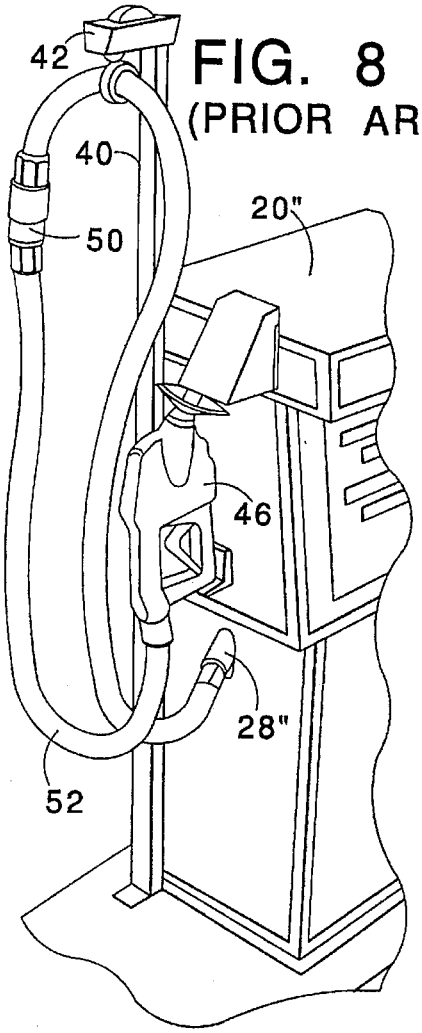
FIG. 8 (PRIOR ART)
FIG. 8 is a perspective view of a conventional fuel dispenser that has no provision for the recovery of vapors during the dispensing of fuel.

FIG. 8 illustrates a prior art dispenser for which no provision has been made for the recovery of vapors during the dispensing of fuel. In this case the single passage hose 52 and non-vapor recovery nozzle and associated components, described in connection with FIG. 1A, are connected to an adapter 28".

Figure 9:
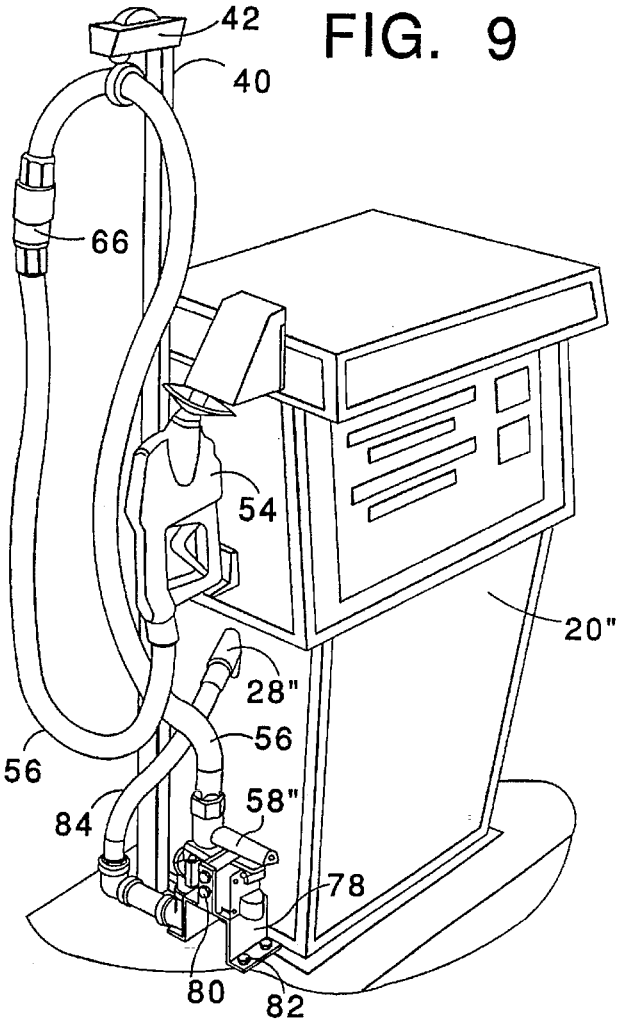
FIG. 9 is a perspective view of the dispenser of FIG. 8 modified in accordance with the present invention to provide for vacuum assisted recovery of vapors during the delivery of fuel into the fuel tank of a vehicle.
Figure 10:
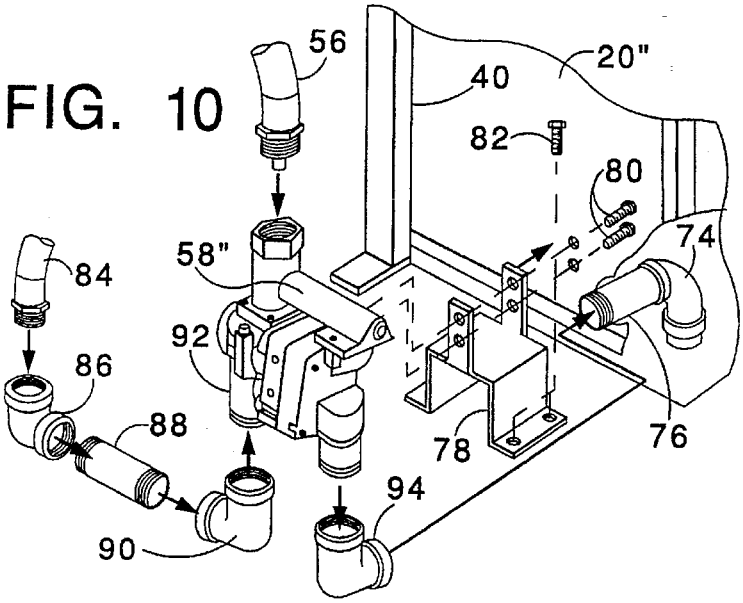
FIG. 10 is an exploded, perspective view illustrating the mounting of the vapor recovery components of FIG. 9.

As a preliminary to converting the dispenser 20" to vacuum assist, vapor recovery operation, it is necessary to provide a conduit connection from the pedestal to the storage tank from which fuel is delivered. The specific manner of providing the conduit connection is immaterial to the broader aspects of the present invention. However, in the usual case, creating a trench from the island on which the dispenser 20" is situated to the storage tank will be necessary, which, usually, is disposed underground. Appropriate conduits are disposed in this trench to provide a connection from the upper portion of the storage tank to a point adjacent the base of the pedestal 20". The upper terminus of the underground vapor return conduit is illustrated in FIGS. 9 and 10 as comprising an elbow 74. A side panel of the dispenser is modified to permit a nipple 76 to project from the elbow 74 to the exterior of the dispenser.

With these preliminaries accomplished, a fuel driven, vacuum pump 58" is mounted adjacent the base of the pedestal 20" Preferably, the fuel driven, vacuum pump 58" is mounted on a bracket 78 by screws 80, with the bracket 78 being secured to the island of the filling station, by screws 82. The vacuum assist vapor recovery components (including the nozzle 54 and hose 56 ("standard" or "inverted") are connected to the fuel driven, vacuum pump 58" in the same fashion as done in the fuel driven, vacuum pumps of the previous embodiments.

The fuel driven, vacuum pump 58" differs from the previous fuel driven, vacuum pumps in the manner of providing fuel and vapor conduit connections with the storage tank from which fuel is being dispensed. The fuel connection comprises a jumper hose 84, which is connected to the adapter 28" and extends to an elbow 86, nipple 88 and elbow 90, with the latter being connected to the fuel passage inlet 92 for the fuel driven, vacuum pump 58". The vapor conduit connection is made by way of an elbow 94 connected to the vapor passage discharge (on the pressure side of the vacuum pump) of the fuel driven, vacuum pump 58" The elbow 94 is connected to the nipple 76 to provide for the flow of vapors back to the storage tank from which fuel is being delivered.

Conversion of the dispenser 20" to a vacuum assisted, vapor recovery operation, as explained in connection with FIGS. 9 and 10, is accomplished with a minimal intrusion into the interior of the dispenser pedestal 20" and, in any event, is accomplished in a simple method that obviates any need to modify existing "plumbing" within the pedestal or other modification of the existing components of the dispenser, beyond substitution of a new hose and nozzle and the addition of a fuel driven, vacuum pump 58.

Figure 11:
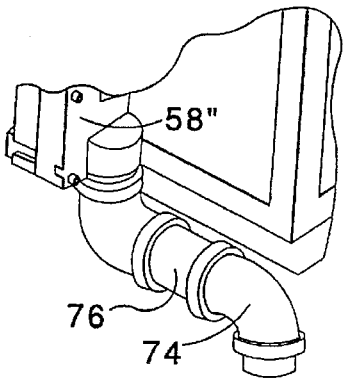
FIG. 11 is a perspective view illustrating an alternate connection with an underground, vapor return conduit, for the components of FIG. 9.

Preferably the vapor conduit elbow 94 is rotatable with respect to the fuel driven, vacuum pump 58". This permits the elbow to be rotated into accurate alignment with the vapor conduit nipple in establishing a connection with the storage tank. It further facilitates elimination of the need to internally modify the existing dispenser 20" to any extent in providing the vacuum assist, vapor recovery capability. This is illustrated in FIG. 11, where it will be seen that the underground elbow 74/nipple 76 are disposed exteriorly of the dispenser pedestal and that the elbow 94 has been rotated (from the relative position of FIG. 10) to connect therewith.

The description herein has referenced replacement of only one nozzle of the illustrated dispensers. It is to be understood that the majority of dispensers are provided with two dispensing nozzles and are internally "plumbed" to provide separate conduit means connected to the storage tank from which fuel is being dispensed from that dispenser. The provision of two nozzles enables fuel to be simultaneously dispensed from both sides of a filling station's island. In practicing the present invention, both nozzles of a dispenser would be converted to vacuum assisted, vapor recovery operation. Conversion of the second side would be identical with that of the one side, as described above. This is to say that a second fuel driven, vacuum pump would be appropriately mounted on the dispenser and a coaxial hose connected to a vacuum assist, vapor recovery nozzle.

It will be apparent from the foregoing that the present invention provides an economical means for either converting a pressure balance, vapor recovery system or a non-vapor recovery system to operation as a vacuum assisted, vapor recovery fuel dispensing system. It is also to be recognized that, in attaining such ends, there is a further safety feature in that all of the additional fuel conduit connections are disposed exteriorly of the pedestal. Thus, should any leakage occur at such connections, liquid fuel would flow to the ground and be observable. The station operator can thus be alerted to the existence of a leak and the need to affect repairs in order to avoid the hazard of a fire or explosion.

Those skilled in the art will recognize variations from the specific embodiments herein described, which variations are to be deemed within the spirit and scope of the present inventive concepts as are set forth in the following claims.

Having thus described the invention, what is claimed as novel and desired to be secured by Letters Patent of the United States is:

1. A method of converting a fuel dispenser from pressure balance, vapor recovery operation to vacuum assisted vapor recovery operation, where the dispenser comprises a pedestal, a pressure balance, fuel dispensing nozzle, a coaxial hose having fuel and vapor passages and connected at one end to the nozzle, an adapter, on the pedestal, having separate connections to a source of pressurized fuel and to a remote receiver for fuel vapors, said coaxial hose being connected, at its other end, to a said adapter with the hose, fueled passage in communication with the pressurized fuel source and places the hose, vapor passage in communication with the remote receiver, comprising the steps of disconnecting the coaxial hose fitting from the adapter, mounting a fuel driven, vacuum pump on the adapter with the source of pressurized fuel in communication with a pump, fuel passage and the vapor receiver in communication with a pump, vapor passage, said pump having an impeller disposed in the pump, vapor passage and driven by flow of fuel through the pump, fuel passage, mounting one end of a coaxial hose on the vacuum pump, to place a hose, fuel passage in communication with an outlet from the pump, fuel passage and to place a hose, vapor passage in communication with an inlet to the pump, vapor passage, mounting a vacuum assist nozzle on the opposite end of the coaxial hose that is mounted on the vacuum pump, thereby providing a vacuum assist in drawing vapors into vapor passage means of the vacuum assist nozzle connected to the opposite end of the coaxial hose.

2. A method as in claim 1 where the coaxial hose of the dispenser, prior to conversion, is a standard coaxial hose, having an inner, fuel passage and ant annular, vapor passage, and the method step of mounting a coaxial hose on the vacuum pump consists in mounting an inverted coaxial hose that has an inner, vapor passage and an outer, fuel passage, thereby eliminating the need for evacuator means in the vapor return passage of the coaxial hose.

3. A method of converting a fuel dispenser to vacuum assisted vapor recovery operation, where the dispenser comprises a pedestal, fuel conduit means and vapor conduit means disposed within said pedestal and providing communication, respectively, with a source of pressurized fuel and a receiver for fuel vapors, means for sealing the vapor conduit means, a fuel dispensing nozzle, hose means connecting the nozzle to the pedestal and placing the nozzle in communication with the source of pressurized fuel, comprising the steps of disconnecting the hose means from the pedestal, removing the sealing means from the vapor conduit means, mounting a fuel driven, vacuum pump at the pedestal with the source of pressurized fuel in communication with a pump, fuel passage and said vapor conduit means in communication with a pump, vapor passage, said pump having an impeller disposed in the pump, vapor passage and driven by flow of fuel through the pump, fuel passage, mounting one end of a coaxial hose on the vacuum pump, to place a hose, fuel passage in communication with an outlet from the pump, fuel passage and to place a hose, vapor passage in communication with an inlet to the pump, vapor passage, mounting a vacuum assist nozzle on the opposite end of the coaxial hose that is mounted on the vacuum pump, thereby providing a vacuum assist in drawing vapors into vapor passage means of the vacuum assist nozzle connected to the opposite end of the coaxial hose.

4. A method as in claim 3 where the dispenser further includes an adapter, the fuel conduit means are connected to the adapter, the vapor conduit means are connected to the adapter, the hose means are connected to the adapter in fluid communication with the fuel conduit means, the sealing means for the vapor conduit means are mounted on the adapter, and the method step of disconnecting the hose means comprises disconnecting the hose means from the adapter, and the method step of mounting the fuel driven, vacuum pump comprises mounting said pump on the adapter.

5. A method as in claim 4 wherein the method step of mounting a coaxial hose on the vacuum pump consists in mounting an inverted coaxial hose that has an inner, vapor passage and an outer, fuel passage, thereby eliminating the need for evacuator means in the vapor return passage of the coaxial hose.

6. A method of convening a fuel dispenser to vacuum assisted vapor recovery operation, wherein the dispenser comprises a pedestal, fuel conduit means connected to a source of pressurized fuel and disposed within said pedestal, fuel conduit adapter accessible from the exterior of the pedestal;

a fuel dispensing nozzle, hose means connecting the nozzle to the fuel conduit adapter, comprising the steps of disconnecting the hose means from the fuel conduit adapter, mounting a fuel driven, vacuum pump at and exteriorly of the pedestal with a pump, vapor passage in communication with a vapor receiver, connecting conduit means between the fuel conduit adapter and a pump fuel passage, said pump having an impeller disposed in the pump, vapor passage and driven by flow of fuel through the pump, fuel passage, mounting one end of a coaxial hose on the vacuum pump, to place a hose, fuel passage in communication with an outlet from the pump, fuel passage and to place a hose vapor passage in communication with an inlet to the pump vapor passage, and mounting a vacuum assist nozzle on the opposite end of the coaxial hose that is mounted on the vacuum pump, thereby providing a vacuum assist in drawing vapors into vapor passage means of the vacuum assist nozzle connected to the opposite end of the coaxial hose.

7. A method as in claim 6 further including the step of supporting the fuel driven, vacuum pump from the structure of the dispenser at a point adjacent to and spaced above ground level.

8. A method as in claim 7 wherein the method comprises the further step of mounting a removable guard on the fuel driven, vacuum pump.

9. A method as in claim 6 where there has been no previous provision for vapor recovery during the dispensing of fuel, wherein the method comprises the further step of installing vapor conduit means that extend from a point adjacent said pedestal to a remote receiver for fuel vapors, thereby enabling the fuel driven, vacuum pump to be placed in communication with a vapor receiver.

10. A method as in claim 9 wherein the method step of installing the vapor conduit means disposes a vapor connector adjacent to and exteriorly of the dispenser pedestal, and including the further step of connecting the vapor connector to the pump vapor passage.

* * * * *

US005636667B1

REEXAMINATION CERTIFICATE (3783rd)

United States Patent [19]

Young et al.

[11] B1 5,636,667

[45] Certificate Issued Jun. 15, 1999

[54] CONVERSION OF FUEL DISPENSERS TO PROVIDE FOR VACUUM ASSISTED VAPOR RECOVERY

[75] Inventors: Jonathan P. Young; Victor A. Schrand, both of West Chester, Ohio; Raymond C. Pilch, Grand Rapids, Mich.

[73] Assignee: Dover Corporation, New York, N.Y.

Reexamination Request:
No. 90/004,835, Nov. 12, 1997

Reexamination Certificate for:

| | |
|---|---|
| Patent No.: | **5,636,667** |
| Issued: | **Jun. 10, 1997** |
| Appl. No.: | **08/399,156** |
| Filed: | **Mar. 2, 1995** |

[21] Appl. No.: 08/399,156

[51] Int. Cl.[6] ..... B65B 31/00

[52] U.S. Cl. ..... 141/59; 141/7

[58] Field of Search ..... 141/1, 7, 44, 45, 141/59, 290; 29/401.1, 888.021; 417/405–408

[56] References Cited

U.S. PATENT DOCUMENTS

| | | | |
|---|---|---|---|
| 5,199,471 | 4/1993 | Hartman et al. | 141/59 |
| 5,265,652 | 11/1993 | Brunella | 141/59 |
| 5,484,000 | 1/1996 | Hasselmann | 141/7 |
| 5,575,629 | 11/1996 | Olson et al. | 417/405 |
| 5,720,325 | 2/1998 | Grantham | 141/59 |

OTHER PUBLICATIONS

State of California Air Resources Board, Executive Order G–70–118; Certification of the Amoco V–1 Vapor Recovery System; Jun. 24, 1988; pp. 1–3 and Exhibits 1–3.

State of California Air Resources Board, Executive Order G–70–118–AA; Modification to the Certification of the Amoco Oil Company V–1 Bootless Nozzle Vapor Recovery System for Gasoline Dispensing Facilities; Mar. 10, 1993; pp. 1–4 and Exhibits 1–3.

State of New York Approval Sheet; DEC Approved System AM05; May 4, 1993; p. 1.

*Primary Examiner*—J. Casimer Jacyna

[57] ABSTRACT

Fuel dispensers are converted to provide vaccum assisted recovery of vapors. Where previously provided with, or "plumbed" for, a pressure balance type of recovery system, the prior hose means is disconnected to permit mounting of a fuel driven, vacuum pump in communication with preexisting fuel and vapor conduit means. Where there has been no prior provision for vapor recovery, conduit means are installed to provide communication between the dispenser pedestal and a remote receiver for fuel vapors. One end of a coaxial hose, preferably of the inverted type, is mounted on the pump and the opposite end of the coaxial hose is connected to a vacuum assist nozzle.

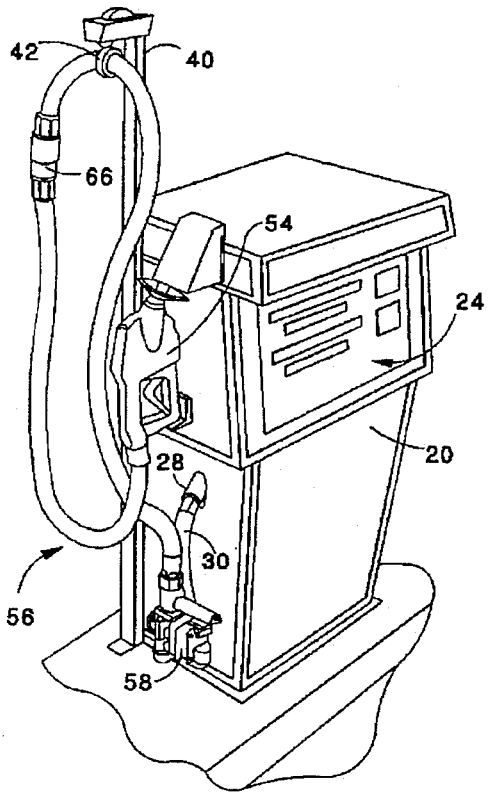

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–10 are cancelled.

* * * * *